US005433405A

United States Patent [19]

Steever

[11] Patent Number: 5,433,405

[45] Date of Patent: Jul. 18, 1995

[54] FIRE HOSE AND POLE SUPPORT COMBINATION

[75] Inventor: Joel A. Steever, Reading, Pa.

[73] Assignee: Thomas Body Parts, Inc., Reading, Pa.

[21] Appl. No.: 227,232

[22] Filed: Apr. 13, 1994

[51] Int. Cl.[6] ..... A62C 13/76

[52] U.S. Cl. ..... 248/75; 280/4

[58] Field of Search ..... 248/75, 76, 77, 78, 248/79, 89, 48.1, 48.2; 7/161; 294/19.1; 280/4

[56] References Cited

U.S. PATENT DOCUMENTS

| | | | |
|---|---|---|---|
| 1,372,571 | 3/1921 | Souter | 248/75 |
| 1,414,834 | 5/1922 | Souter | 248/75 |
| 1,893,166 | 1/1933 | Fox | 248/75 |
| 4,436,267 | 3/1984 | Eads et al. | 248/75 |

*Primary Examiner*—Ramon O. Ramirez

[57] ABSTRACT

A combination support for carrying a length of hard suction hose and a pike pole on a fire pumper engine. The support includes an elongated open ended metal trough sized for supporting a length of hard suction hose placed within an open top of the trough. The hose may be secured in position with quick release straps attached to the trough. The trough is attached and supported horizontally disposed, with the open top of the trough facing upward, by two triangular mounting brackets connected between the trough and fire engine. Both mounting brackets are affixed to a vertical surface of the fire engine with bolts or the like. Each bracket is structured with a transverse opening, with the openings of the brackets being in alignment with one another when the brackets are mounted. The openings are sized for accepting and supporting a straight length of hollow tubing inserted and affixed therein, and spanning between the two brackets. The relatively small diameter tubing is sized to receive the handle of a pike pole, and thereby the pike pole may also be stored on the truck. Both the trough and the brackets are preferably made of extruded aluminum which has an anodized finish for economics of manufacturing, durability and appearance of the product.

6 Claims, 8 Drawing Sheets

FIRE HOSE AND POLE SUPPORT COMBINATION

BACKGROUND OF THE INVENTION

1. Field of the Invention

This invention relates to fire fighting equipment in general, and more precisely to a combination support structured for holding, in a stored mode, both a length of hard suction hose and a pike pole of the types commonly found on fire pumper engines (trucks). The support primarily includes an elongated metal trough structured to support the hard suction hose, with the trough supported by brackets fastened to the fire engine. The brackets are additionally structured for supporting a length of tubing for holding the pike pole.

2. Description of the Prior Art

There are several types of fire hoses normally carried on conventional fire engines today, with the most widely used type being the more commonly known flexible high pressure hoses which the firemen hold while fighting the fires. There are also other larger diameter and shorter sections of hose, referred to as hard suction hoses, which are primarily carried on and used in conjunction with a pumper type fire engine for drawing or sucking water out of an open reservoir with vacuum, such as a swimming pool, lake or pond, and thus the hard nature of the hose prevents it from collapsing under the vacuum. Hard suction hoses are normally around 8 to 11 feet in length, and normally ranging between 4 to 6 inches in diameter, and are substantially more rigid in comparison to the output hoses used to spray water onto fires, and although hard suction hose does posses a degree of flexibility, it is slight. Therefore, these hard suction hoses cannot be coiled or rolled-up for storage on the fire truck as the output fire hoses are, but must be stored substantially straight and preferably in a horizontal and fully supported position on the fire engine.

Another piece of equipment commonly used by firemen is a hooked pole referred in the trade as a pike pole, which generally comprises an elongated handle with a metal hook on one end. The pike pole is used for pulling down small sections of a burning structure for better access into the structure by the fire hose and water spraying therefrom.

The disadvantage involving conventional fire engines and pumper engines in use today is that most are manufactured without any type of supports for the hard suction hoses or the pike poles. The fire departments purchasing the fire engines must specifically order a custom specialized holding rack built for the hard suction hoses and pike poles when ordering the fire engine, as there are currently no ready made supports or clamps offered for this purpose.

While there are several prior art clamping structures or holders for hoses, none of these appear available today, presumably due to significant and apparent shortcomings. One such hose holder is taught by D. Souter in U.S. Pat. No. 1,372,571 issued Mar. 22, 1921. The Souter hose holder includes a wire form bracket attachable to vertical or horizontal surfaces, having a swinging frame supporting a pair of opposing pivoted jaws structured for clamping a hose therebetween. The handles of the pivoted jaws are weighted which helps draw the jaws together around the hose, and when the hose is pulled out from connection with the jaws, helps to maintain the jaws in an open position for reinsertion of the hose. One disadvantage of this device requires the fireman to push up on the relatively heavy hose to reinsert it back into the holder. Another disadvantage is the swinging nature of the holder which would allow the hoses to swing while connected to the fire engine. Another disadvantage of the Souter device is that it only supports the hose in short areas contacted by the clamp, and therefore the majority of the hose is left hanging under its own weight or unsupported.

Another hose holder patented by Souter is taught is U.S. Pat. No. 1,414,834, dated May 2, 1922. This hose holder is also formed of thin metal wire and basically includes a U-shaped bracket affixable to a vertical surface. The U-shaped bracket is affixed with a pivotal member, a section of which serves as the outer side wall. The pivotal member is fitted with a weight which maintains the side wall in an upright position until a person pulls the weight upward, rotating the side wall downward which rolls the hose out of the holder. This device is also not suited for supporting suction connection hoses on a fire engine due to similar disadvantages already mentioned in Souter's previously mention invention. Neither of the Souter devices provide anything for supporting a pike pole.

A suction hose support apparatus is taught in U.S. Pat. No. 1,893,166, which was issued to Fox on Jan. 3, 1933. Fox's support apparatus includes the use of at least two brackets, each consisting basically of a arc-shaped body having two semi-circular seats sized for holding the ends of two suction connection hoses. Each bracket includes a rotatable clamp which retains the hoses securely in position. The brackets are structured for supporting only one small section of the hoses, and not the full length thereof. Also, Fox's support apparatus must be affixed to vertical posts on the fire engine which are not conveniently located on modern fire engines for suitable use as hose supports. Fox's apparatus, like that of Souter's, does not provide structure for supporting a pike pole.

SUMMARY OF THE INVENTION

The present invention is a combination support structured for holding, in a stored mode, both a length of hard suction hose and a pike pole on a fire pumper engine (truck). The combination support primarily includes an elongated rigid metal trough, with an upper open area of the trough sized for longitudinally supporting essentially the full length of a hard suction hose when placed within the trough. The elongated trough is supported toward each end by a triangular metal support bracket having a flat attachment base which is for attachment to a surface on the rearward side of a fire engine with fasteners such as bolts. A triangular or extending portion of the brackets connected to the attachment base extends outward from the attachment base. A surface of the triangular or extending portion serves as the supporting surface for the metal trough. The trough is attached to the brackets with fasteners such as nuts and bolts for example. The triangular or extending portion of each of the brackets also includes a transverse opening sized for retaining the proximal ends of a section of tubing affixed in the opening and spanning between the two brackets. The tubing is sized for longitudinal passage of the pike pole handle. One end of the tubing is preferably affixed with a releasable holding structure for connection to the pike pole for retaining the pole within the tubing. The open top area or surface of the trough is also affixed with releasable hold down straps, preferably having a degree of elasticity, for retaining the hard suction hose in place while the fire engine is driven to the fire.

The trough and brackets are preferably manufactured of aluminum in an extrusion process which allows the parts to be quickly and inexpensively produced, and for the components to be rigid and durable, light in weight, and generally corrosion resistant. The aluminum parts are also preferably anodized to produce a smooth shiny finish which is easy to clean and further helps prevent corrosion.

The trough is structured to be positioned lengthwise horizontally on the fire engine, with the open top area facing upward for supporting the hose. The trough extends approximately the full length of the suction hose to prevent damage or kinking of the hard suction hose, and to prevent the hose from taking a set in a curve due to long term sagging. Ideally, the trough is of a length wherein the two couplers, one at each oppositely disposed end of the suction hose, hang or are positioned just beyond the terminal ends of the trough, with this being for the purpose of allowing the hose to lay perfectly flat in the trough. This ideal trough length to hose length is difficult to practically achieve since hard suction hoses vary in length somewhat, but a trough length of 9 foot 6 inches normally works as a good overall trough length, since most hard suction hoses are 10 feet in overall length. The endward hose couplers are slightly larger in diameter than the hard suction hose, and would create a slight bow in the hose if the couplers were also directly supported by the trough.

The pike pole can be easily slid into the opening of the tubing from the rear end of the fire engine. Storage of the pike pole together with the suction hose helps conserve space on the already crowded fire engine.

A major object of the present invention is to provide a simple to use and highly effective combination support for both the hard suction hoses and pike poles carried on fire engines.

A further object is to provide a combination support which may be readily attached to just about all pumper fire engines, and sized for all existing hard suction hoses and currently used pike poles.

Another object is to provide a combination support for a hard suction hose and pike pole which is light in weight, strong so as not to be easily damaged during the haste of fire fighting, and one which is corrosion resistant and easy to maintain clean and looking good for many years.

Other objects and advantages of the invention will become apparent by examination of the remaining specification, and appended drawings and claims.

DESCRIPTION OF THE PREFERRED EMBODIMENT

Figure 1:
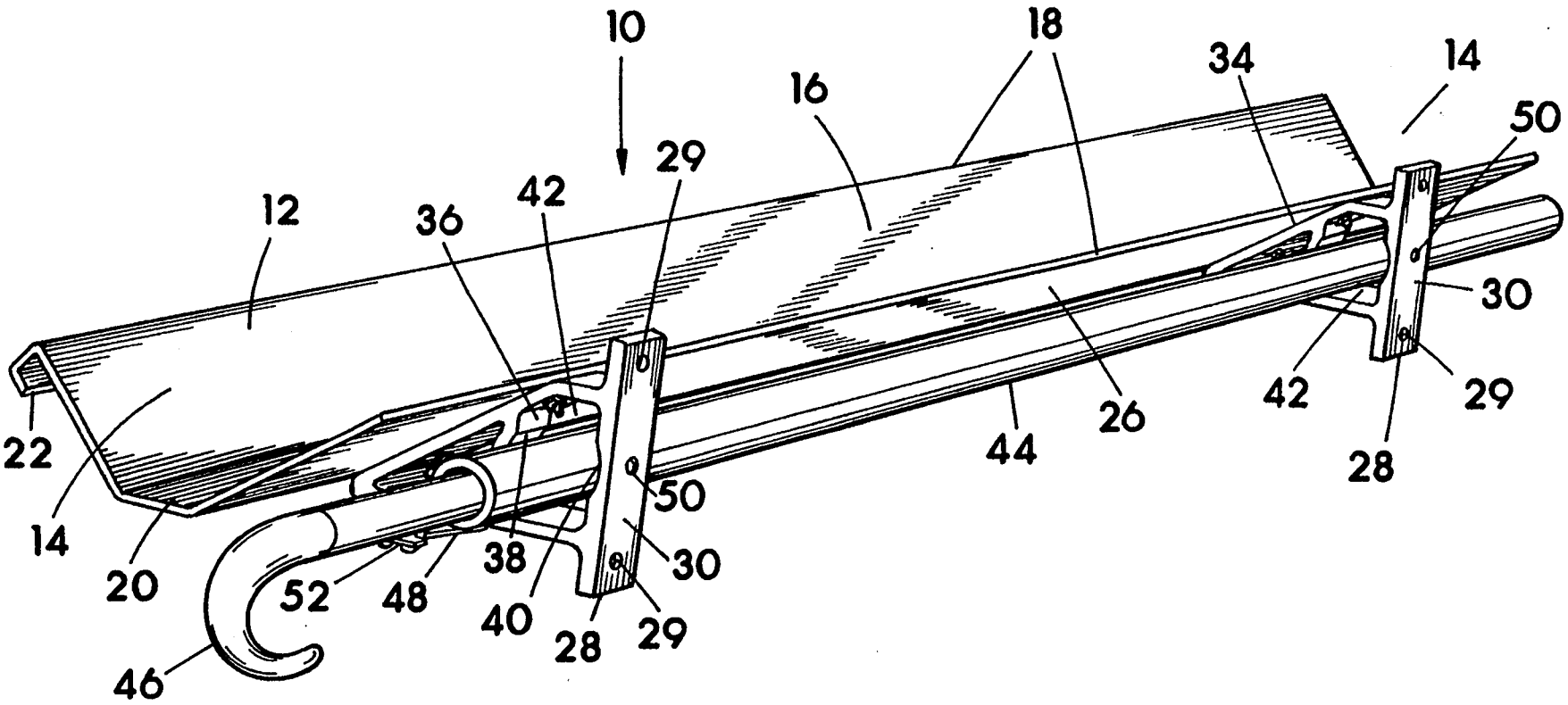
FIG. 1 is a top rear perspective view of a combination support for a length of hard suction hose and a pike pole in accordance with the present invention.
Figure 2:
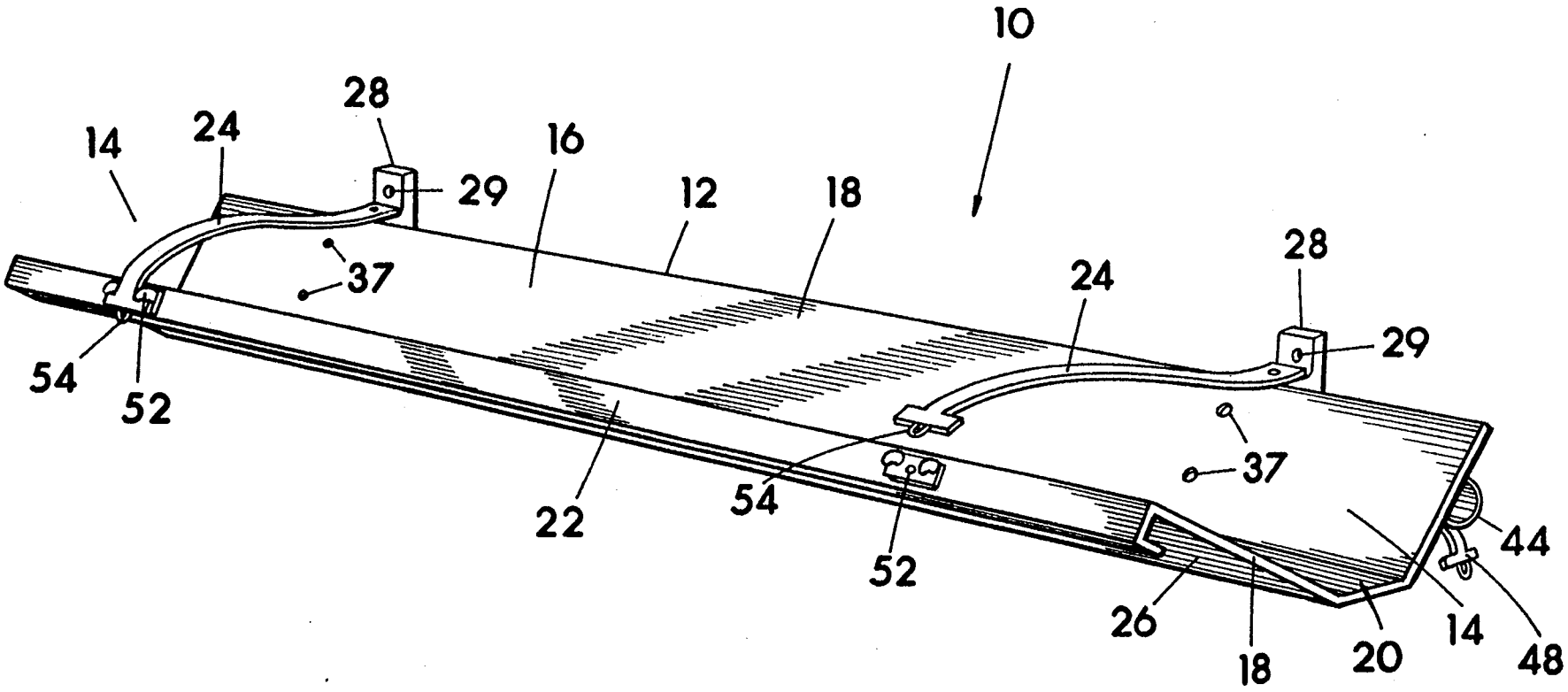
FIG. 2 is top front perspective view of the combination support. Releasable hold down straps for retaining the hose are shown affixed to the brackets and the edge of the trough.

Referring now to the drawings in general where an example of the present invention is illustrated and generally designated as combination support 10. Combination support 10 includes an elongated rigid trough 12 having two oppositely disposed open ends 14, an open top surface 16 which faces upward in use, and two outwardly sloped side walls 18 with a flat lengthwise base or floor 20 between the two side walls 18. One lengthwise outer edge of the sloped side walls 18 is formed into a U-shaped flange 22, which finishes this outer edge in a manner which will not cut or scrap a person, and it additionally strengthens this edge. The oppositely disposed open ends of trough 12 are preferably left open in order to accommodate unusually long lengths of suction hose wherein a short distance of an unusually long hose may hang over the ends of the trough, and also to allow the sliding removal of the hose from either open end of the trough if desired. Trough 12 is supported on the underside or bottom surface 26 of one side wall 18 by a narrow generally triangular rigid support bracket 28, at least one bracket 28 near each proximal end of trough 12. Each of the two support brackets 28 are structured with a triangular portion affixed to a base or mounting plate designated attachment base 30. The attachment base 30 is for connection of the support bracket 28 to a vertical surface of the fire engine 32, which will in almost all cases be on the rearward outside side edge of the utility cargo bed of the engine 32 behind the driver's cab. Combination support 10 is structured to allow one embodiment thereof to be attached to either the left or right rearward side of the fire engine, and generally parallel to the length of the engine 32. The triangular portion of the bracket 28, which extends outward from base 30 and the fire engine, includes an upper surface 34 as the supporting surface for trough 12. This upper surface 34 of the triangular portion of brackets 28 includes two holes 35 which are alignable with holes in trough 12, whereat trough 12 is secured to brackets 28 with the use of nuts and bolts 37, although other suitable fasteners such as rivets or welding may be used, nuts and bolts function well and allow the easy removal of the trough 12 from the brackets 28 if desired. Attachment bases 30 includes bolt holes 29, and the brackets 28 are preferably affixed to fire engine 32 with bolts 31 and nuts, or bolts 31 into threaded bosses, or large screws passed through holes 29 in each base 30, although other suitable fastenings such as riveting may also be used. Two fastener receiving holes 29 through each base 30 are preferred for strength and stability. Attachment bases 30 may be mounted to strut channel with spring-nuts in the strut channel, with the strut channel being bolted or otherwise connected to the fire engine 32, with this being an arrangement which would readily allow some vertical height adjustment in the precise location of the brackets 28, depending of course on the length of the strut channel.

Figure 3:
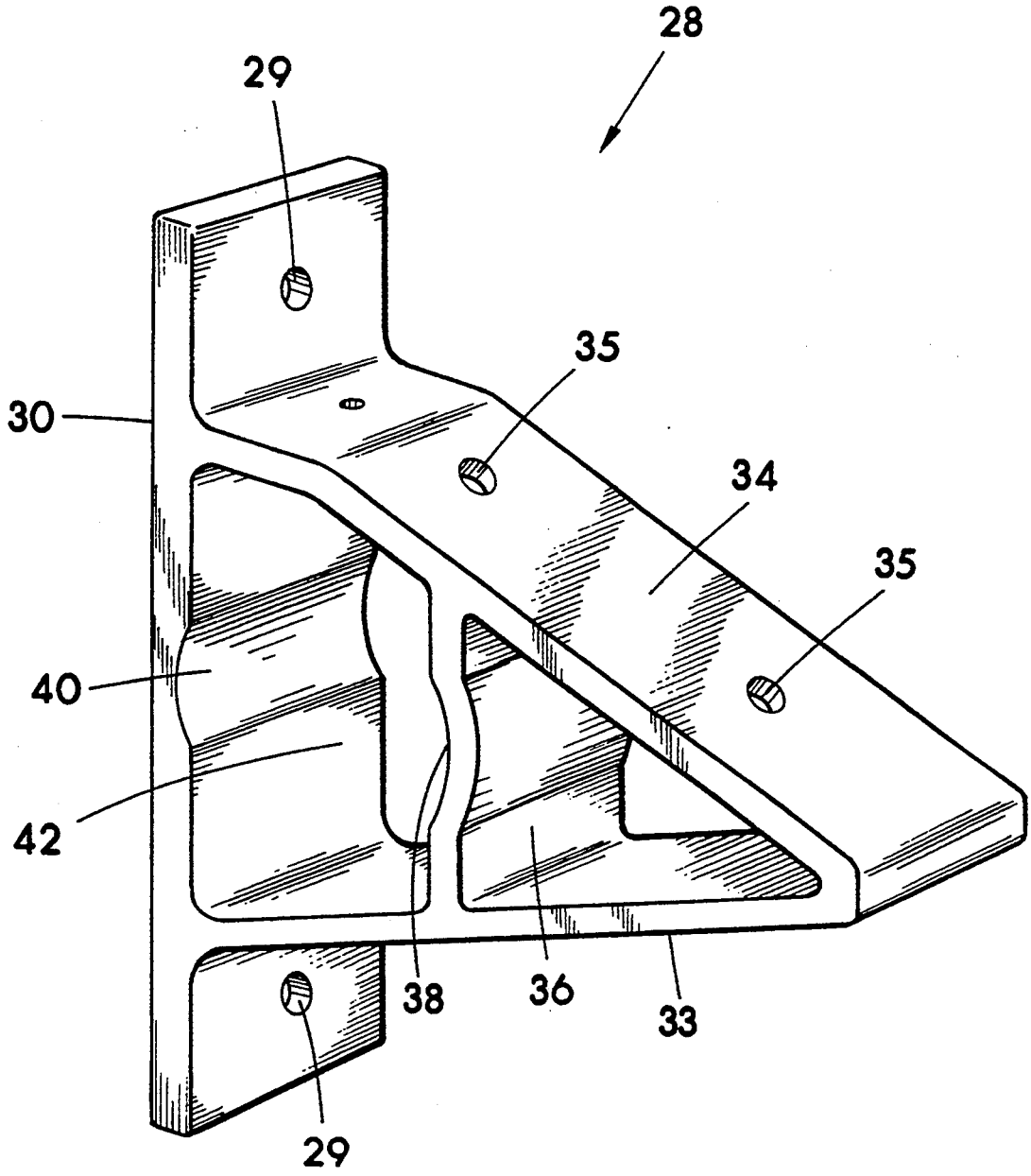
FIG. 3 is a perspective view of one of the mounting brackets in accordance with the present invention.

As shown best in FIG. 3, the triangular portion of bracket 28 is essentially defined by upper member or upper surface 34 extending outward from its attachment from base 30, then angling slightly downward and meeting a distal end of lower member or surface 33 attached and extending from base 30. An open hollow area is defined between upper surface 34 and lower surface 33. The central and generally open area of the triangular portion of each bracket 28, below upper surface 34, extends transversely relative to base 30, and is divided into a tube receiving area by a wall 36 which is positioned generally parallel to base 30 and in spaced relationship thereto, and spanning between the underside of top surface 34 and the interior or top surface of the bottom 33 of the triangular portion as shown in FIG. 3. The center section of wall 36 is structured with a slight curve 38 which bows away from the interfacing wall of attachment base 30. Aligned with the curve 38 on wall 36 is a slight concavity 40 incorporated into the interior surface of attachment base 30. Both curve 38 and concavity 40 define a transverse opening 42 which is structured for passage of and close fit to an elongated section of a hollow tubing 44 spanning between at least two brackets 28. When in use, both brackets 28 support the proximal ends of tubing 44 within the two openings 42 thereof, and the tubing 44 is affixed in position with countersunk bolts 50 through taped holes in bases 30 which serve as set-screws to render tubing 44 stationary relative to brackets 28. Other suitable attachment arrangements may be used to render tubing 44 stationary relative to brackets 28, such as rivets or welding for example. The tubing 44 is retained generally in lengthwise parallel alignment to trough 12. The tubing 44 is sized in the open interior diameter for lengthwise retaining a pike pole 46 handle, which consists primarily of an elongated pole with a metal hook on one end. At least one end, and normally the rearward most end, of the tube 44 is left open for insertion and removal of the handle of the hooked pole 46, however both ends are preferably left open to accommodate extra long pole handles. If only one end is left open, it will normally preferably be the end nearest the rear of the fire truck since the pole 46 may be inserted and removed from the unobstructed rear end of the truck. To secure pike pole 46 within tubing 44, so as to prevent the pole from inadvertently sliding out of the tube 44, one end of tubing 44 (the open end) is affixed with a releasable holding strap 48 which connects to a hooked attachment member 52 located on the pike pole 46. Holding strap 48 includes an elongated elastic strap affixed on one end, preferably with rivets 50, to the distal end of tubing 44. The free end of holding strap 48 widens into a "T"-shape which is structured for placement over and between the two hooks located on the attachment member 52. Preferably there is a small projection to serve as a handle or finger hold 54 on the end of the "T" which is structured for easier grasping by the fingers of the fireman, and it is used to quickly and easily free strap 48 from connection to attachment member 52 by pulling forward and up on the "T"-shaped free end. Other arrangements such as twist-locks, compression fitting locks, magnets, or any other suitable arrangement may be used to prevent the inadvertent sliding of the pole 46 from tubing 44 while the engine 32 is traveling to the fire. The hook portion of the pike pole 36 is larger than the diameter of tubing 44, and therefore the pole cannot slide all the way through the tube 44. Tubing 44 will normally be 2 inch nominal sized tubing.

Figure 4:
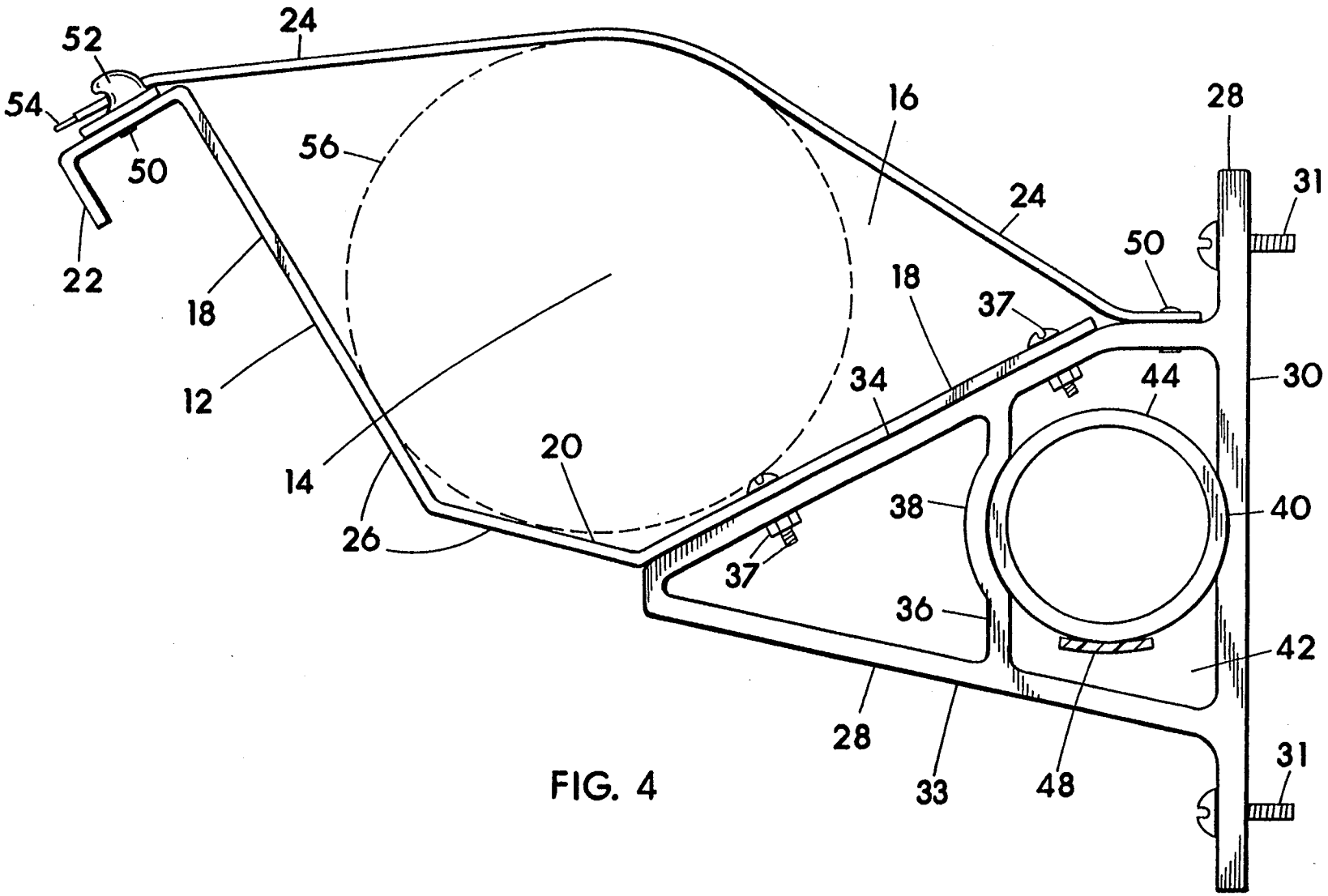
FIG. 4 is an end view of the combination support for a length of hard suction hose and a pike pole in accordance with the present invention. The pike pole is not shown. A hard suction hose is shown in dotted lines in the trough, and the end of the tubing structured for retaining the pike pole is shown affixed to the bracket.
Figure 5:
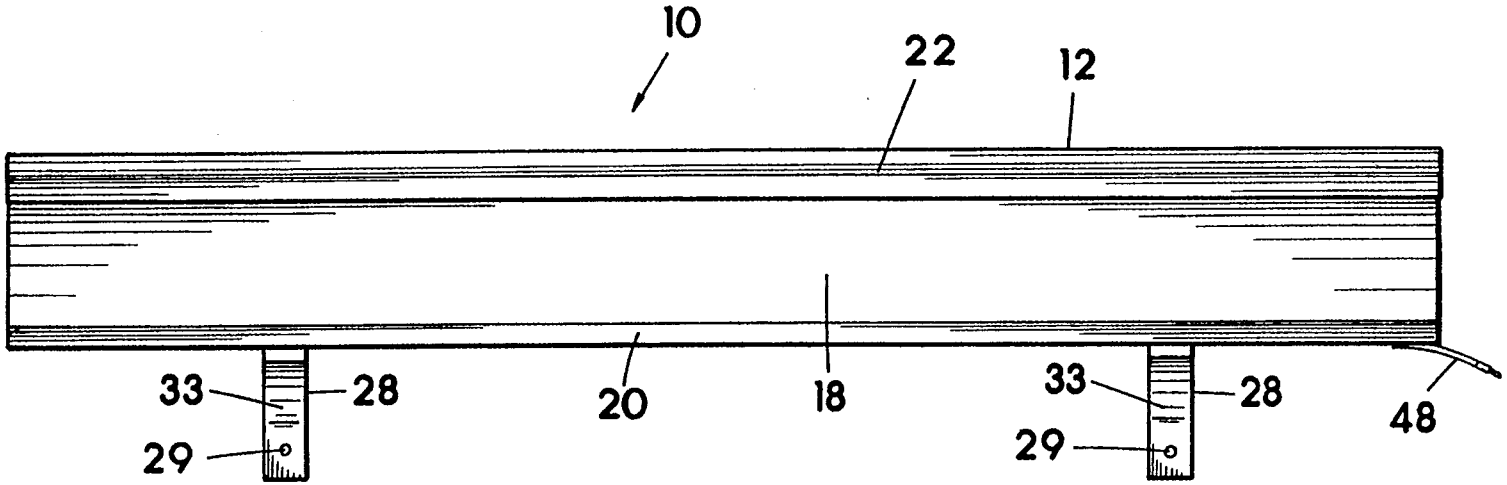
FIG. 5 is a front view of the combination support in accordance with the present invention.
Figure 6:
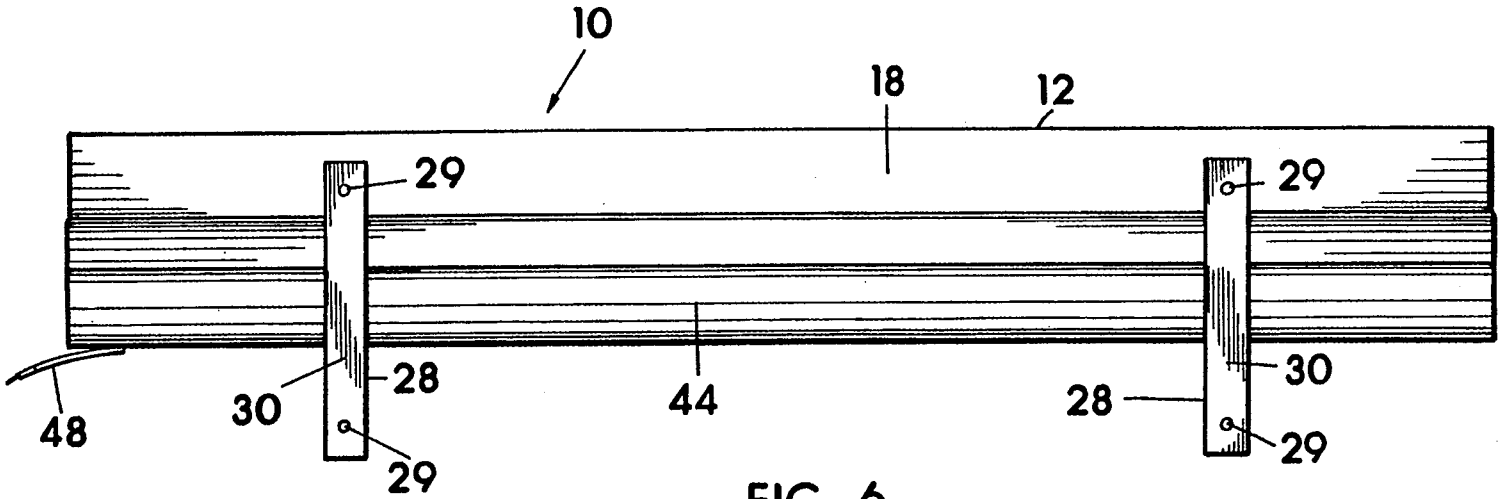
FIG. 6 is a rear view of the combination support in accordance with the present invention.
Figure 7:
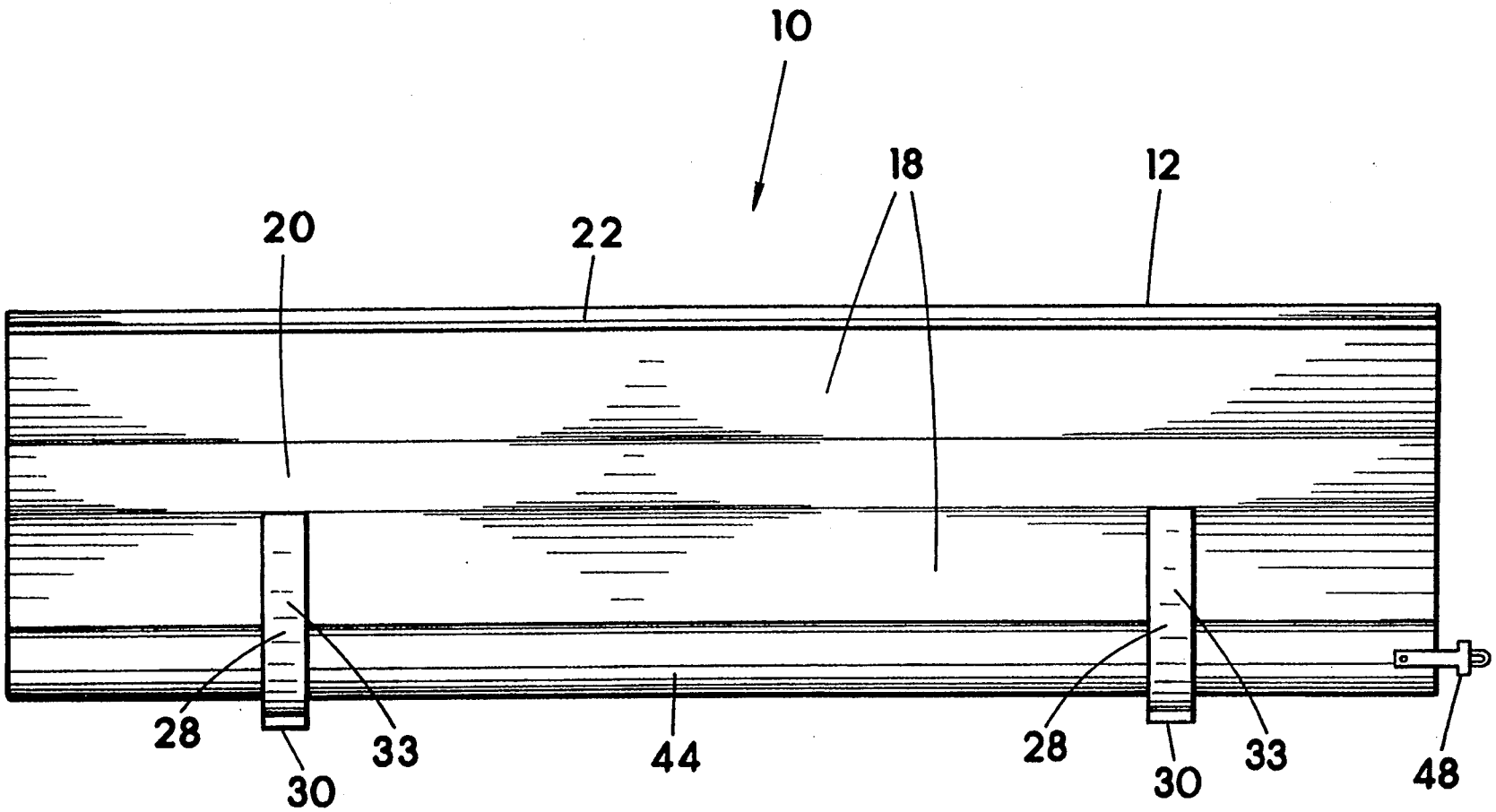
FIG. 7 is a bottom plan view of the combination support in accordance with the present invention.
Figure 8:
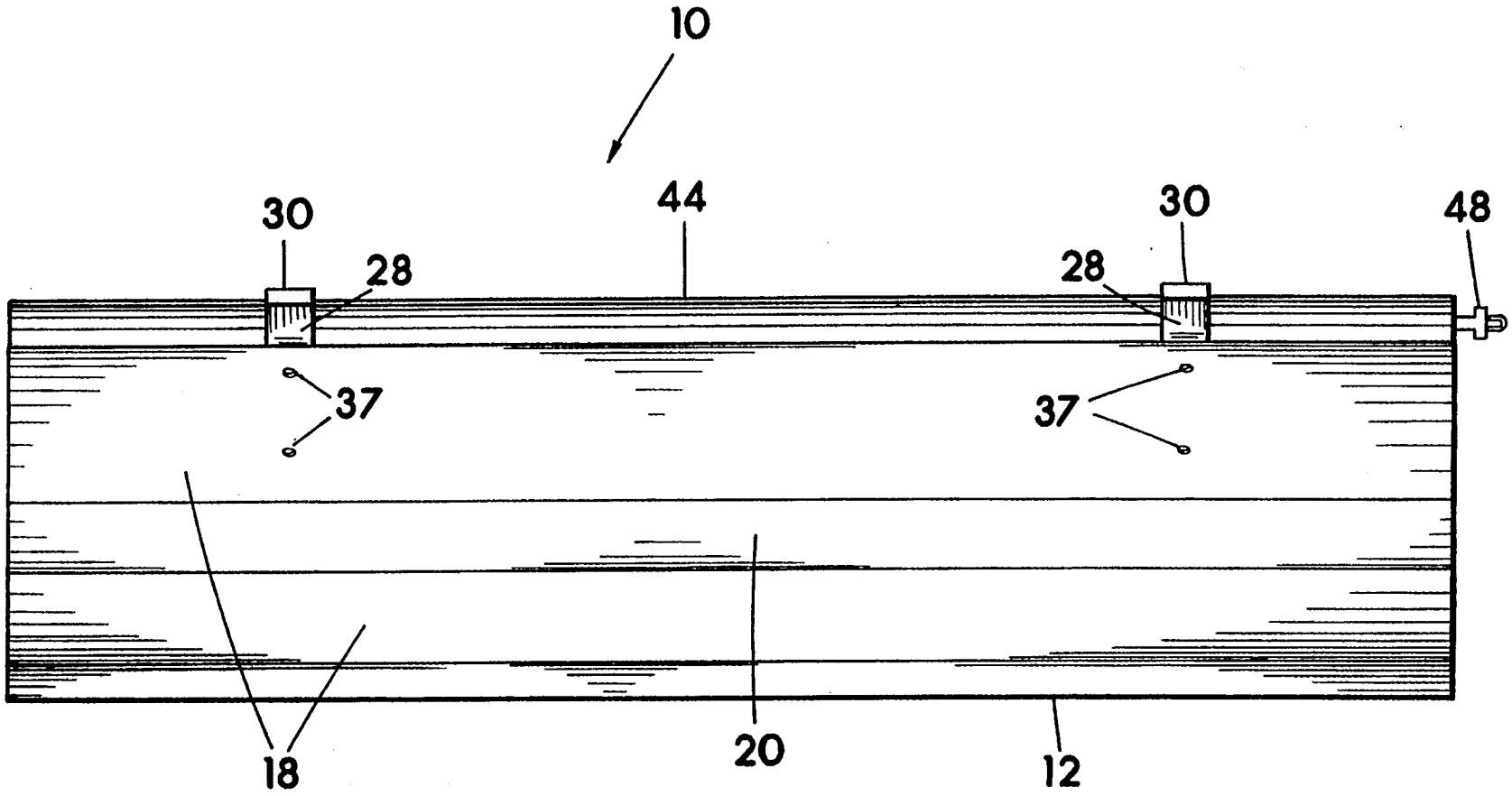
FIG. 8 is a top plan view of the combination support in accordance with the present invention.
Figure 9:
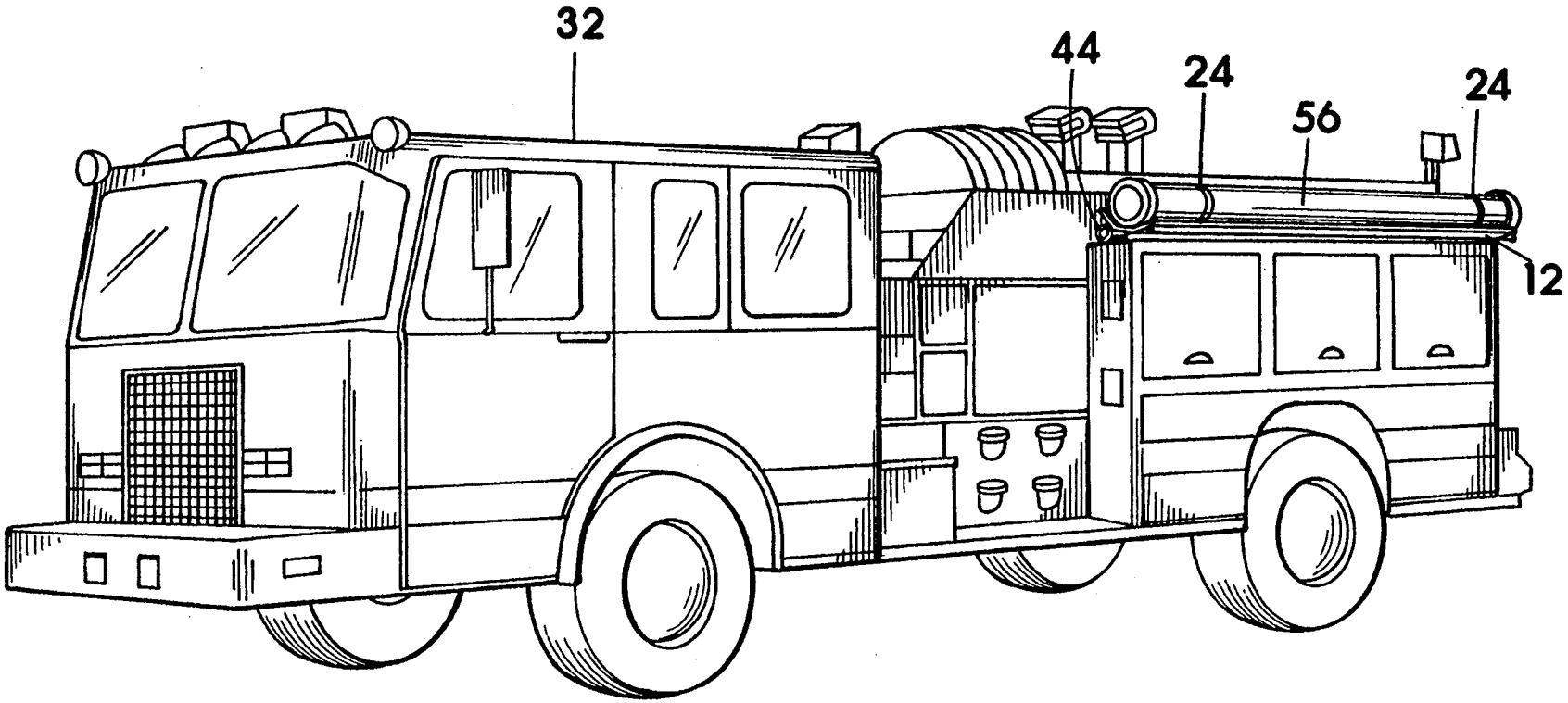
FIG. 9 is a perspective view of a fire engine having a combination support attached thereto, and a length of hard suction hose is shown supported in accordance with the present invention.

As previously stated, the open top surface 16 of the trough 12 is sized for longitudinally supporting a section of hard suction hose 56. Trough 12, when in use, is slightly angled, with floor 20 angled approximately ten degrees, to further maintain the hose 56 in position while the fire engine 32 is moving, by locating the hose into a "V" or angled corner in the bottom of trough as indicated in FIG. 4. Two releasable hold down straps 24 are provided affixed adjacent each end 14 of trough 12 on brackets 28. Each elastic strap 24 is similar to holding strap 48, and also having a "T"-shaped free end. One end of each hold down strap 24 is riveted or otherwise affixed to the bracket 28 adjacent the supporting surface 34 and attachment base 30. The "T"-shaped free end of each hold down strap 24 is releasably connected to an attachment member 52, similar to attachment member 52 affixed to pike pole 46, which is affixed to the flange 22 of trough 12, directly across from brackets 28. To secure suction hose 56 firmly in place, hold down strap 24 is stretched tightly over the outer surface of hose 56 and the "T"-shaped free end is hooked over the two hooks of the attachment member 52, essentially as previously described for holding strap 48. Other arrangements such as releasable clamps may be used to prevent the inadvertent sliding of the hard suction hose 56 from trough 12 while the engine 32 is traveling to the fire.

Trough 12 and brackets 28, are preferably comprised of a corrosion resistant material such as anodized aluminum, and are preferably extruded in order to better hold dimensions, and to maintain a relatively low manufacturing cost. Since aluminum is relatively light in weight, there is little excess weight added to the already heavy fire engine 32. A bright dipped anodized finish on the aluminum will further add to the corrosion resistance. Brackets 28 may be made in long lengths of extruded aluminum utilizing a double hollow extrusion die, followed by the long length being cut, such as by sawing, into narrow individual brackets. It is anticipated that in some rare instances brackets 28 will be structured for mounting on a horizontal surface of the fire engine, wherein the attachment bases 30 will rest horizontally, and the extending portion (triangular portion) attached to and extending from the bases 30 will project and be shaped suitably so as to still be able to support trough 12 as previously described, i.e., open top of the trough 12 facing upward, and the brackets 28 will still retain a tube 44 for holding a hooked pole much as described above.

Although the preferred structures and use of the invention have been specifically described by way of example, some changes in the specifics described and shown may clearly be made without departing from the true scope of the invention in accordance with the appended claims.

What I claim as my invention is:

1. A combination support for holding both a length of hard suction hose and a hooked pole on a fire engine, comprising:

an elongated rigid trough having an open top facing upward for receiving and holding a length of hard suction hose in a stored position within said trough, at least two rigid support brackets each including an attachment base for attaching the brackets in spaced relationship to one another to a vertical surface of the fire engine, each bracket further including a generally triangular portion connected to and extending outward from the base, a top portion of each triangular portion of each of the brackets being a supporting surface attached to an underside of said trough, each of the brackets further including an opening defined transversely through the triangular portion, a hollow elongated tube inserted and affixed within said openings and extending between said at least two rigid support brackets, said elongated tube extending generally lengthwise parallel to said trough, said elongated tube having at least one opened end and sized in open interior diameter to receive a handle of a hooked pole so as to store the hooked pole.

2. A combination support according to claim 1 wherein said elongated rigid trough in made of corrosion resistant metal and said brackets are made of corrosion resistant metal for durability.

3. A combination support according to claim 2 wherein corrosion resistant metal of both said trough and said brackets is aluminum shaped by extrusion.

4. A combination support according to claim 3 wherein said trough further includes releasable hold-down means for affixment over a suction hose within said trough for retaining the hose in said trough while the fire engine is driven.

5. A combination support according to claim 4 wherein said elongated tube further includes releasable holding means for retaining the hooked pole within said tube while the fire engine is driven.

6. A combination support for holding both a length of hard suction hose and a hooked pole on a fire engine, comprising:

an elongated rigid trough having an open top facing upward for receiving and holding a length of hard suction hose in a stored position within said trough, at least two rigid support brackets each including an attachment base for attaching the brackets in spaced relationship to one another to a surface of the fire engine, each bracket further including an extending portion connected to and extending outward from the base, a portion of each extending portion of each of the brackets being a supporting surface attached to an underside of said trough, each of the brackets further including an opening defined transversely through the extending portion, an elongated hollow tube inserted and affixed within said openings and extending between said at least two rigid support brackets, said elongated tube extending generally lengthwise parallel to said trough, said elongated tube having at least one opened end and sized in open interior diameter to receive a handle of a hooked pole so as to store the hooked pole.

* * * * *